United States Patent [19]

Cline et al.

[11] 4,016,663

[45] Apr. 12, 1977

[54] ELECTRIC PRESSING IRON

[75] Inventors: Melvin N. Cline, Orange, Calif.; Robert John Augustine, Downers Grove; Donald John Westphal, South Elgin, both of Ill.

[73] Assignee: Sunbeam Corporation, Chicago, Ill.

[22] Filed: May 21, 1976

[21] Appl. No.: 688,858

[52] U.S. Cl. ..... 38/77.83

[51] Int. Cl.[2] ..... D06F 75/06

[58] Field of Search ..... 38/77.83, 77.5, 77.6, 38/77.7, 77.8, 77.81, 77.82

[56] References Cited

UNITED STATES PATENTS

| | | | |
|---|---|---|---|
| 2,353,425 | 7/1944 | Woodmann | 38/77.83 |
| 3,703,777 | 11/1972 | Knapp | 38/77.83 |
| 3,711,972 | 1/1973 | Risacher | 38/77.83 |

*Primary Examiner*—Patrick D. Lawson
*Attorney, Agent, or Firm*—George R. Clark; Neil M. Rose; John S. Pacocha

[57] ABSTRACT

An electric pressing iron having a smooth, substantially non-porous, corrosion resistant member secured within a recess at the bottom of a valve seat. This member, surrounding the orifice portion of the water control valve between the iron water tank and steam generating chamber, will reduce corrosion and the attachment of mineral deposits at this critical section of the steam iron, thereby extending the life of the iron as well as maintaining consistent control of water flow.

5 Claims, 2 Drawing Figures

ELECTRIC PRESSING IRON

BACKGROUND OF THE INVENTION

This invention relates to an electric ironing device and, more particularly, to an electric pressing iron having an improved efficiency and greatly extended life.

In recent years, consumers have demonstrated a strong preference for electric pressing irons capable of producing and discharging steam for facilitating the ironing operation by relaxing so-called stubborn or deep set wrinkles in fabric. These irons normally consist of a cast aluminum sole plate having an electric sheathed heater imbedded therein. Overlying the sole plate is a water tank connected to feed water into a steam generating chamber defined in part by a cavity in the sole plate. Also defined by the sole plate are passageways which connect to a plurality of steam discharge ports in the bottom surface of the sole plate whereby water entering the cavity is converted to steam by the heat supplied by the heater. The steam is discharged through the ports to the material being ironed. A suitable handle is assembled over the tank and normally carries the controls for regulating the temperature of the sole plate as well as means for actuating the steaming operation by controlling the valve disposed in the water conduit between the tank and the sole plate steam generating cavity. In some irons, means are also provided to generate a momentarily, stronger surge of steam. Such means are disclosed in the Gronwick et al U.S. Pat. No. 3,599,357, assigned to the same assignee as the present invention. The surge of steam obtained in irons such as disclosed in the Gronwick et al. patent is further effective in relaxing some of the extremely deep set wrinkles in the fabric.

One of the problems associated with today's steam irons which are often used with fairly hard water, is corrosion within the valve assembly between the water tank or reservoir and the sole plate steam generating cavities. There are also often deposits which form in and around this valve assembly and which affect the efficiency and operation of the steaming process or can also block the passage of water completely. Of the approaches taken to correct this situation, the Downing U.S. Pat. No. 3,675,351 discloses the use of a control valve made completely of ceramic. The approach disclosed in the Downing patent is less satisfactory from the standpoint of reducing deposits and presents problems from a manufacturing and design standpoint. A completely ceramic valve is itself difficult to support because of tolerance problems. Furthermore, it cannot adequately be used as a supporting member between the water reservoir and the sole plate due to the weaker structural properties of ceramic including its tendency to crack and break.

It would thus be desirable to maintain a metallic control valve assembly which can further function as support means and to construct the orifice portion, being the section most susceptible to corrosion and obstructing deposits, of a non-porous, and relatively hard material. Furthermore, by having only the orifice portion made of a separate material it would further be possible to obtain an extremely smooth and hard material such as a synthetic jewel without the cost of having the entire valve structure made up of this relatively expensive material.

SUMMARY OF THE INVENTION

Briefly, the improved electric steam iron of the present invention incorporates a steam iron of typical construction including a sole plate provided with a steam generating labyrinth contained therein, a pumping means to supply water from a water tank overlying the sole plate into the steam generating labyrinth, and a control valve disposed between the tank and the labyrinth for setting the rate of water flow therethrough, the improvement comprising the use of a synthetic jewel as the orifice portion of the control valve. The effects of using a synthetic jewel at the orifice of the control valve include longer iron life and greater consistent control of water flow.

The effects of long life and consistent water flow are accomplished in that the orifice portion is maintained at an established opening configuration, free from corrosion or the formation of mineral deposits during use. Specifically, advantages of the particular jewel being used so as to prevent corrosion or the collection of mineral deposits include its almost zero porosity so that there are no molecular holes for deposits to attach, its fine smoothness thereby minimizing surface roughness where deposits would also attach, and the high chemical resistance of the jewel so that being inert to most reagents it is further highly corrosive resistant. The synthetic jewel being used is also extremely hard which eliminates scratches from handling and further maintains its fine surface smoothness. Finally, the synthetic jewel has a dimensional stability at all temperatures encountered in a steam iron. With such a dimensional stability the orifice size changes less with temperature than would stainless steel and thus allows for a more consistent control of water flow.

The jewel is attached to the control valve by a ring stake procedure. In this manner, the jewel is secured in place by part of the valve being forced to extend over and overlap the valve. This procedure will securely attach the jewel and yet allow for the differing rates of expansion at high temperatures of the jewel as compared with the valve material.

Accordingly, it is an object of the present invention to provide a new and improved electric steam iron having effective means for discharging water from the water reservoir or tank to the steam generating chambers.

It is another object of the present invention to provide a new and improved electric steam iron having a control valve orifice portion which is highly resistant to corrosion and further resistant to the attachment of mineral deposits.

It is still a further object of the present invention to provide a new and improved steam iron having a control valve assembly of a metallic material so that it can be used as a structural member whereas the orifice portion thereof is of a non-metallic material having low porosity and high hardness properties.

It is yet another object of the present invention to provide a synthetic jewel as the orifice portion of a steam iron control valve and secure this jewel to the valve in a manner allowing for the differing expansion rates at high temperatures.

Further objects and advantages for the present invention will become apparent as the following description proceeds, and the features of novelty which characterize the invention will be pointed out with particularity in the claims annexed to and forming a part of this specification.

BRIEF DESCRIPTION OF THE DRAWINGS

For a better understanding of the present invention, reference may be had to the accompanying drawings in which.

DESCRIPTION OF THE PREFERRED EMBODIMENTS

Figure 1:
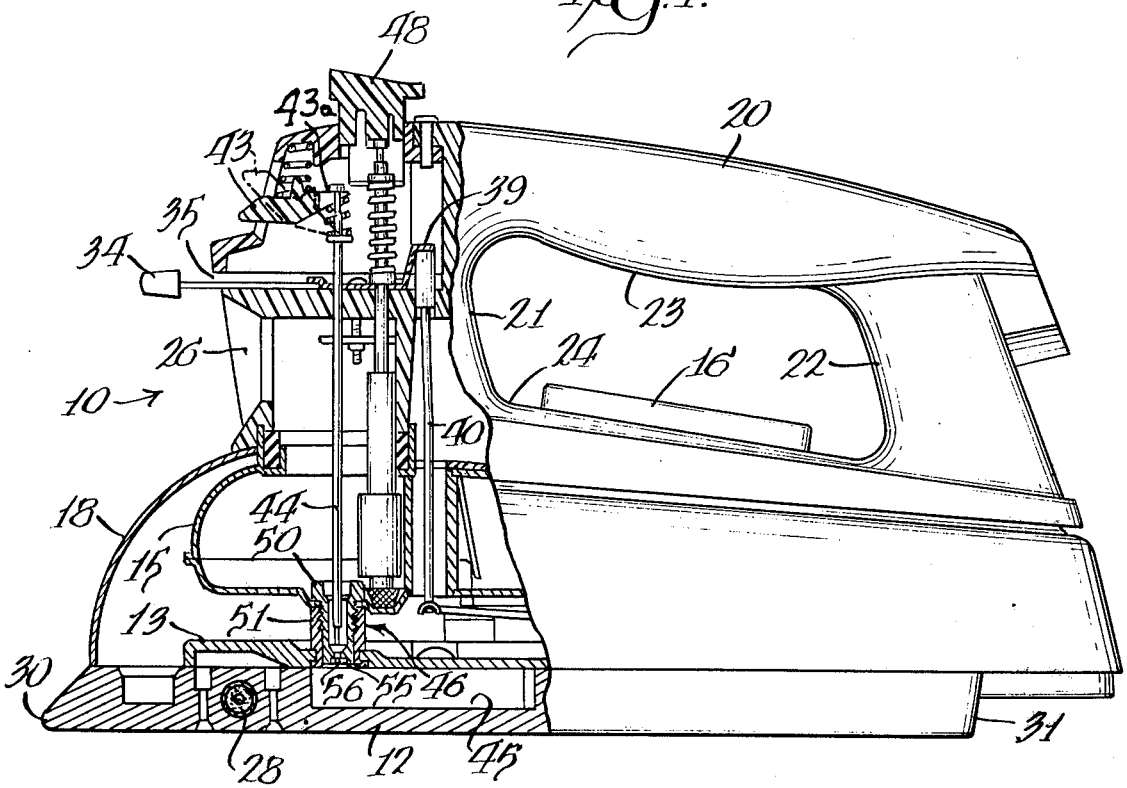
FIG. 1 is a side elevational sectional view of an electric pressing iron embodying the present invention.

Referring now to the drawings wherein like reference characters designate corresponding parts throughout the several views, there is shown an electric pressing iron generally designated by reference numeral 10. As can be seen from FIG. 1, the iron 10 includes a sole plate 12 having secured thereto a steam chamber cover 13 over which is supported a water tank 15 with a water level sight gauge 16 attached to its upper surface. Overlying the upper surface of the sole plate 12 and enclosing the water tank 15 is a shell 18 to which is attached a looped handle 20 having a front upright portion 21, a rear upright portion 22, upper hand-gripping portion 23 and lower saddle portion 24. In order to give the user a visual indication of the quantity of water contained within tank 15, the sight gauge 16 projects through the saddle portion 24 of the handle 20, and the sight gauge is adapted to be read when the iron is in its stable upended position.

The water tank 15 can be conveniently filled by pouring water through fill opening 26 in the front of the handle upright portion 21. For the purpose of heating the sole plate 12, a U-shaped sheathed electric heater 28 is imbedded within the sole plate. Preferrably, the sole plate is formed of aluminum which readily transmits the heat from the heater 28, and it is fabricated by a casting technique which facilitates the imbedding of the heater 28 therein. For controlling the energization of the heater 28 and for regulating the temperature of the sole plate 12, there is provided a thermostat (not shown) which includes a bi-metallic element (not shown) in good heat transfer relationship with the sole plate at a point approximately in the middle of the heater 28 and towards the rear of the sole plate.

The sole plate has a generally standard outer configuration with a front pointed toe 30 and a relatively flat rear portion 31. To selectively set the thermostat, a lever 34 extends through a slot 35 in the handle front upright portion 21 immediately above the fill opening 26. The lever 34 is attached to a rotatable cam 39, the rotation of which determines the vertical displacement of link 40 which extends through the water tank 15 and is attached at its lower end to the thermostat.

Mounted at the front of the handle above the lever 34 is a lever 43 which controls the flow of water to the steam generating chamber. The lever 43 is pivoted about its midpoint as is obvious from FIG. 1 where it is shown in dashed lines in its alternative position. When it is desired to use the electric pressing iron 10 in a steaming mode, the user pushes downwardly on lever 43 causing it to rotate in a counter-clockwise direction to the position shown in solid lines in FIG. 1. The flow of water from the reservoir is controlled by a valve rod 44 which extends vertically from the bottom of reservoir 15 into connection with a bifurcated end **43*a* of the lever 43. The rod 44 has an enlarged end which engages the end 43*a* of lever 43 as shown in FIG. 1. As a consequence, when lever 43 is pivoted counterclockwise, it raises the rod 44 opening gravity feed valve 46 disposed at the bottom of tank 15 to establish fluid communication between the tank 15 and steam generating cavities 45 located within the sole plate 12. When it is desired to have a more penetrating steam than is achieved by gravity flow, the user presses a button 48 located at the top of the handle front upright portion 21** which produces the pumping action fully described in Gronwick et al. U.S. Pat. No. 3,599,357, assigned to the same assignee as the present invention.

The valve assembly 46 includes a bushing or hollow post 51 rigidly staked to the cover 13 and a hollow bolt 50 threadably attached to the post 51 locking the tank 51 securely therebetween. The bolt 50 comprises a hollow bored portion **50*b* and a tapered inside wall 50*c* sloping toward a reduced diameter orifice portion. The tapered wall 50*c* of bolt 50 forms the valve seat for the rod 44. The post 51 and bolt 50 of the valve assembly 46 act as a structural member securing the water tank 15 in proper position above the cover 13.**

Figure 2:
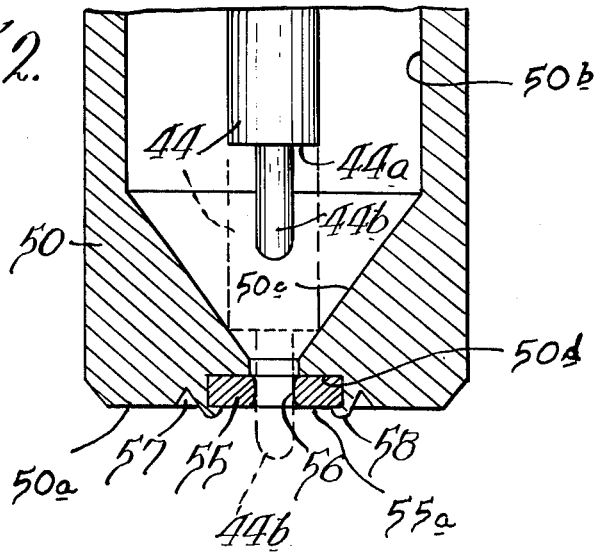
FIG. 2 is a sectional view of the control valve orifice of the present invention.

As best shown in FIG. 2 the base of bolt 50 of the control valve assembly 46 has secured thereto and within a recess **50*d* thereof a synthetic jewel 55 containing a hole or orifice portion 56. When the pressing iron 10 is not being used in its steaming mode but merely being used as a dry iron, rod 44 is in its lowered position as shown in dashed lines in FIG. 2, whereby the circumference of bottom surface 44*a* of rod 44 will abut and seal against the inside tapered surface 50*c* of bolt 50. The inside of bolt 50 thusly acts as the valve seat of the valve assembly 46 preventing the passage of water therethrough. A pin portion 44*b* of rod 44 will protrude through the orifice 56 in the jewel 55 as the rod 44 is in its lowered position. The pin 44*b* will further block the passage of water through the valve assembly 46, but of primary importance, it will act to clean or unclog the orifice 56 from any mineral deposits which have accumulated. To open valve 46 for the steaming mode, rod 44 is moved to its upward position as described above, thereby opening the orifice 56 allowing water to drip slowly therethrough into the steam generating cavity 45 in sole plate 12** at the rate of approximately 12 grams per minute.

The specific rate of water flow when the iron is used in the steaming mode has been established for the most efficient creation of steam and use of the iron. This rate is controlled by the size of the orifice portion 55 of control valve 46. Obviously, corrosion of this orifice in use or the attachment of mineral deposits commonly found in tap water will adversely affect the operation of this valve by effectively changing the orifice size or clogging it completely. In order to prevent this type of damage which has typically taken place in the previously used stainless steel valves, the orifice portion of the present invention has been constructed of a low porosity, smooth and hard material. Although various materials can be used at the orifice, the preferred embodiment makes use of a synthetic corundum ($Al_2O_3$) jewel. This synthetic jewel has a zero porosity and as such there are no molecular holes for deposits to attach. Furthermore, this synthetic jewel can be finished to a very fine smoothness thereby minimizing surface roughness to which deposits might also attach. Another advantage of this particular synthetic jewel is that it is practically inert to most reagents and thus highly resistive to corrosion.

When the pressing iron 10 is used in its steaming mode, water drips down from the tank 15, through the valve assembly 46, and into the chamber 45 where, upon contact with the hot sole plate 12, the water is converted into steam. Upon this boiling process and conversion from water to steam, the residue mineral deposits which do not evaporate are scattered throughout the steam generating chamber 45. In this manner, with irons of the past, mineral deposits would typically accumulate on the lower surface 50*a* of bolt 50 of the valve assembly. After extended use of the iron, this accumulation could be so great that the orifice 56 would be completely blocked and pin 44*b* would not even be able to penetrate and free this blockage. With the use of the synthetic jewel 55 in the present invention, however, this accumulation of mineral deposits at the orifice 56 is greatly reduced. Although there will still be mineral deposit accumulation at surface 50*a* of bolt 50, these deposits will not secure to the lower surface 55*a* of jewel 55 surrounding the orifice 56. In this manner, any deposits which may even bridge over the surface 55*a* and be loosely attached to cover the bottom of the valve assembly can be easily removed and pushed aside by the pin 44*b* of rod 44. The use of the synthetic jewel 55 will greatly facilitate the maintenance of a clean and unobstructed orifice portion 56 of valve assembly 46.

A further advantage of the synthetic jewel 55 used surrounding the orifice portion 56 of the control valve is that it is dimensionally stable at all temperatures encountered in use in a steaming iron. As such, the orifice size changes very little with temperature variations and thereby maintains a more consistent control of water flow. In order to attach the jewel 55 at the bottom and within the recess 50*d* of bolt 50 and yet allow for the differing expansion rates between the jewel and the stainless steel valve body, the jewel is secured by a ring stake method. This causes a groove 57, shown in FIG. 2, to be formed around the jewel 55 forcing the displaced metal portion of bolt 50 to overlap and retain the jewel at a ridge 58. In this fashion, the synthetic jewel is securely attached while at the same time room is allowed for the expansion of the control valve body.

While there have been shown and described several embodiments of the present invention, it will be apparent to those skilled in the art that numerous changes and modifications may occur, and it is intended in the appended claims to cover all such changes and modifications which fall within the spirit and scope of the present invention.

What is claimed as new and desired to be secured by Letters Patent of the United States is:

1. In an electric steam pressing iron the combination comprising a sole plate having a cavity formed in the upper surface thereof, a cover over said cavity forming with said sole plate a steam generating chamber, a water reservoir overlying said sole plate, a valve assembly to control the flow of water from the reservoir to said steam chamber, said valve assembly engaged with the bottom of said reservoir and having a base secured to said cover, a valve seat threadably received in said base to retain said reservoir with respect to said base, a movable valve member to control water flow, said valve seat having a passageway extending therethrough with an intermediate shouldered portion against which said valve member abuts to prevent water flow, a portion of said passageway extending from said shouldered portion to said steam chamber being of reduced diameter, said reduced diameter being formed in part by an annular synthetic jewel.

2. The combination of claim 1 wherein said valve seat comprises a stainless steel member formed with a recess coaxial with said passageway, said synthetic jewel being received with said recess, said valve seat being deformed adjacent to said coaxial recess to provide portions overlapping said jewel to retain it assembled to said stainless steel member.

3. An electric steam iron comprising a sole plate, an electric heater in said sole plate, a water tank overlying said sole plate, said sole plate defining a steam generating chamber, a valve for controlling water flow from said tank to said steam generating chamber, said valve including a metallic valve seat with a recess at the bottom surface thereof, an orifice portion made up in part of a material different than said valve seat, said different material of said orifice portion being of low porosity and a high level of smoothness, and said different material secured within said recess and extending radially outwardly at the bottom surface of said valve seat.

4. An electric steam iron as in claim 3 wherein said different material of said orifice is a synthetic jewel.

5. An electric steam iron as in claim 4 wherein said synthetic jewel is ring staked to said valve seat in order to secure said jewel within said recess.

* * * * *